US005720634A

United States Patent [19]

Sten

[11] Patent Number: 5,720,634

[45] Date of Patent: Feb. 24, 1998

[54] SINGLE PIECE FEMALE TERMINAL

[75] Inventor: Robert Leroy Sten, Warren, Ohio

[73] Assignee: General Motors Corporation, Detroit, Mich.

[21] Appl. No.: 674,948

[22] Filed: Jul. 3, 1996

[51] Int. Cl.[6] ..... H01R 13/187

[52] U.S. Cl. ..... 439/843; 439/845

[58] Field of Search ..... 439/843–847

[56] References Cited

U.S. PATENT DOCUMENTS

| | | | |
|---|---|---|---|
| 2,426,429 | 8/1947 | Bels | 439/843 |
| 3,538,491 | 11/1970 | Longenecker et al. | 339/256 |
| 3,634,879 | 1/1972 | Longenecker | 439/844 |
| 4,148,547 | 4/1979 | Otsuki et al. | 439/843 |
| 4,461,531 | 7/1984 | Davis et al. | 439/843 |
| 5,147,230 | 9/1992 | Plyler et al. | 439/843 |
| 5,186,663 | 2/1993 | Wymelenberg | 439/843 |
| 5,340,337 | 8/1994 | Pentz | 439/843 |

*Primary Examiner*—J. J. Swann

*Attorney, Agent, or Firm*—Cary W. Brooks; Ernest E. Helms

[57] ABSTRACT

An electrical female terminal of a one-piece construction is provided including a contact portion at one end and an attachment portion at an opposite end for attaching the terminal to a cable; the contact portion including a split outer barrel that is attached to the attachment portion by an intermediate neck of reduced diameter; the outer barrel having a pair of longitudinal edges defining the split and an annular lip at its front end defining an entrance for plugging a mating terminal pin into the outer barrel; the contact portion also including a connection strap joined to the outer barrel along the front end of the outer barrel generally opposite the longitudinal edges defining the splits, the connection strap being folded rearward into the outer barrel; and the contact portion further including two spring contact beams juxtaposed by the connection strap, the spring contact beams and connection strap being formed into an inner barrel encircled by the outer barrel, the spring contact beams having front edges extending toward the front end of the outer barrel, and radially spring-biased against the mating terminal pin plugged within the outer barrel.

7 Claims, 6 Drawing Sheets

SINGLE PIECE FEMALE TERMINAL

FIELD OF THE INVENTION

This invention relates generally to electrical female terminals and more specifically to electrical female terminals that are attached to electric cables for use in sealed electrical connectors of the "plug through" type disclosed in U.S. Pat. No. 4,946,402, issued Aug. 7, 1990, to Fink et al.

This patent discloses a female terminal for "plug through" type sealed electrical connector that has an elastomeric seal that is mounted on the cable end of a connector body before the electrical female terminals that are attached to the ends of electric cables are installed. These electrical female terminals are inserted into terminal cavities of the connector body through aligned holes in the elastomeric seal, that is, the electrical female terminals are "plugged through" the seal. The holes are sized to fit tightly around the electric cables when the electrical female terminals are installed so as to seal the cable end of the electrical connector.

BACKGROUND OF THE INVENTION

It is already known to provide electrical female terminals of two piece construction for these "plug through" arrangements comprising a main terminal member and a protective can or hood. In these known terminals, the main terminal member has spring contact fingers at one end and crimp means at the other end to attach the main terminal member to the end of an electric cable. The protective can or hood surrounds the spring contact fingers to protect the fingers and provide a round, protrusion free contact end that facilitates the electrical female terminals being pushed through tight holes in the elastomeric seal during installation.

This two piece terminal is expensive to manufacture because of poor material utilization and slow manufacturing processes. Two components are required and the assembly speed is limited to 200 parts per minute.

It is also known from U.S. Pat. No. 3,538,491, issued Nov. 3, 1970, to Longenecker et al. to provide an electrical pin receptacle 21 (FIGS. 4–7) of one piece construction.

This pin receptacle 21 comprises a spring contact assembly 13 that is inside a barrel member 11. The spring contact assembly 13 and the barrel member 11 are integrally attached to each other by an extension 15 that is reversely bent upon itself.

This design reduces construction costs because of its one piece construction. However, the pin receptacle 21 is not suitable for a sealed electrical connector of the "plug through" type described above because the pin receptacle 21 does not have any provision for attaching the pin receptacle 21 to an electric cable. Moreover, the pin receptacle 21 does not have a round, protrusion free contact end that would facilitate the pin receptacle being pushed through a tight hole in an elastomeric seal easily. This is due primarily to the presence of flared mouth 17 and cooperating ears 19 that provide stop means to limit the movement of the pin receptacle 21 within a hole of a printed circuit board of a carrier member.

Another disadvantage of the pin receptacle 21 is inherent to its spring contact assembly 13. This spring contact assembly 13 is formed to mate with a pin terminal 23 at its point of smallest diameter, generally along section 25. Section 25 is separated from a face 27 by a distance 29. Distance 29 is important in that it mandates a required minimum length of the pin terminal 23. Any increase in length of the pin terminal 23, although minute individually, greatly affects cost due to the high volume of such terminals. Any increase in the length of the pin terminal 23 also significantly decreases the pin terminal's resistance to bending. Distance 29 cannot be shortened since it is mandated to allow for the proper crimping of the spring contact assembly 13 to provide an appropriate crimped section 25.

Additionally, having a spring contact assembly 13 with a crimped section 25 is not as desirable from an electrical contact standpoint because contact wings provide better spring properties for a terminal. Furthermore, it is harder to maintain contact concentricity with a crimp designed contact than with a wing designed contact.

Another known female terminal 31 is disclosed in U.S. Pat. No. 5,186,663 issued Feb. 16, 1993, to Wymelenberg (FIGS. 1–3).

Referring to FIG. 1, the flat metal blank for making the terminal 31 of Wymelenberg has a forward contact portion 33 which includes a generally rectangular part 35 that is rolled to form a split cylindrically shaped socket 37. The forward contact portion 33 also includes two strips 39 that are attached to opposite longitudinal edges of the rectangular part 35 by a short narrow support tabs 41 that are located near the rearward end of the rectangular part 35. The strips 39 are bent to form two longitudinal contact arms that are disposed within the socket 37 that is rolled from the rectangular part 35. The blank for the terminal 31 further includes a rearward winged part 45 that is formed into crimp wings 43 and 47 for attaching the terminal 31 to the wire of an electric cable and to the cable insulation.

As mentioned previously, the strips 39 form longitudinal contact arms. The arms have a medial diverging portion 49 that preferably engages the inside surface of the socket 37 forwardly of the support tabs 41. The strips 39 forwardly of the medial diverging portions 49 have deflectable contact fingers 51 for biasingly engaging a mating terminal. Between the socket 37 and the winged part 45 is a cylindrically shaped neck 55.

Although the Wymelenberg terminal 31 offered a potential improvement to what was disclosed in the prior art, it proposed significant manufacturing difficulties and ensuring consistency and associated tolerances in the point of contact 53 of the strips 39 with the interior surface of the socket 37. Deviation from the contact point 53 between the strips 39 and the socket 37 could have major impact upon the normal force that the contact finger 51 places upon an inserted male pin terminal. The normal force is important in that too little normal force inhibits proper electrical contact and too much force can increase insertion force to a range which is undesirable or unacceptable.

The criticality of the proper operation of electrical connectors has been heightened with the increase of safety equipment which are dependent thereon, such as anti-lock braking systems and supplemental inflation systems (commonly referred to as air bags). Accordingly, with the advent of feasible technology, the automated inspection of female terminals has increased.

Referring to FIG. 12, one method of inspection is to provide a light source 63 which shines a beam 69 through a female terminal 65 to an optical receiver 67. The optical beam 69 is being utilized primarily to ensure the proper location of the contact fingers or arms inside the socket 71. However, before the beam 69 can reach the socket 71, it must pass through a cylindrical neck 73.

Referring back to FIGS. 1 through 3, the Wymelenberg female terminal 31 has a crimped cylindrical neck 55. When using the Wymelenberg terminal 31 with very small diameters, such as 2 mm or less (socket diameter), the cylindrical neck diameter is 1.5 mm. Small cylindrical neck diameters create a tendency for neck edges 57 to be pushed inwardly when crimped. This inward crimping of the neck edges 57 typically will not allow proper passage of a light beam to use a visual inspection technique. Therefore, inspections must be handled on a sample basis and 100 percent inspection technologies become unfeasible.

Due to the joining of the strips 39 by the support tabs 41, when the terminal 31 is folded, the bending of the metal can cause a slight depression 59 to exist in the outside cylindrical wall of the socket 37. This slight depression 59 is not desirable since it provides an opportunity for the elastomeric seal which the terminal must penetrate through to snag upon it. The affect of this slight depression 59 is virtually impossible to eliminate regardless of the care in the manufacturing process.

SUMMARY OF THE INVENTION

The present invention in its preferred form provides an electrical one-piece female terminal. The terminal has a contact portion at one end and an attachment portion at the opposite end for attaching the terminal to an electrical cable. The contact portion has a split outer barrel that is attached to the attachment portion by an intermediate neck of a reduced diameter. The contact portion also includes a connection strap joined to the outer barrel along a front end of the outer barrel generally opposite the longitudinal edges of the outer barrel defining the split. The connection strap is folded rearwardly into the outer barrel. The connection strap further juxtaposes two spring contact beams. The connection strap with the contact beams form an inner barrel which is encircled by the outer barrel. The spring contact beams have front edges which extend toward the front end of the outer barrel and are radially spring-biased against a mating terminal pin which is plugged within the outer barrel.

The present invention allows the spring contact arms to be independent of any contact and not depend upon the outer barrel as a fulcrum point for better concentricity, and for giving more consistent normal forces (on an inserted pin terminal) which leads to better electrical contact and better control of insertion forces. Additionally, since the front edges of the contact arm extend towards the front edge of the outer barrel, the pin which mates with the female terminal does not have to be as long as that required in the terminal as disclosed in Longenecker et al. The present invention provides a one piece female terminal that functionally and dimensionally duplicates prior two piece female terminals while being less costly to manufacture. Prior one piece female terminal designs could not meet such a criteria.

These and other advantages of the present invention will be more apparent to those skilled in art as the present invention is further disclosed in the accompanying drawings and detailed description.

DETAILED DESCRIPTION OF THE DRAWINGS

Figure 1:
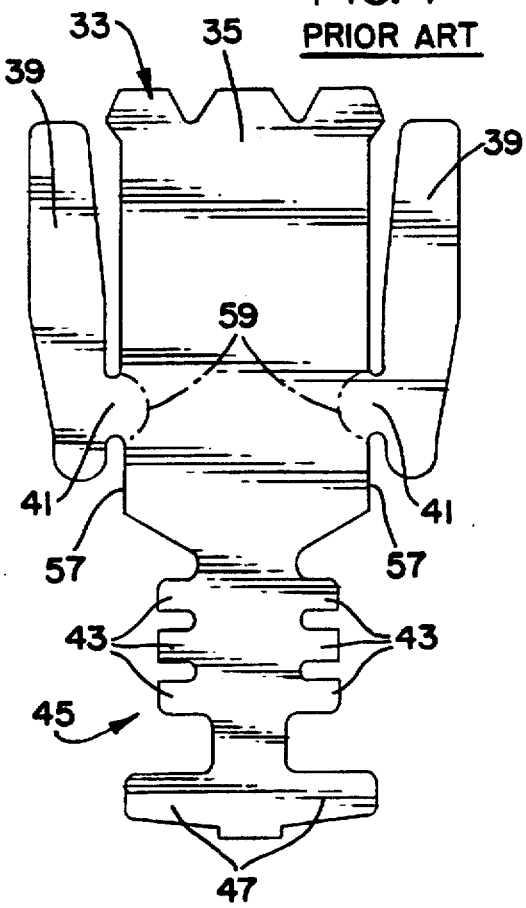
FIG. 1 PRIOR ART
FIG. 1 is a top plan view of a blank utilized in preparing a female terminal according Wymelenberg.
Figure 2:
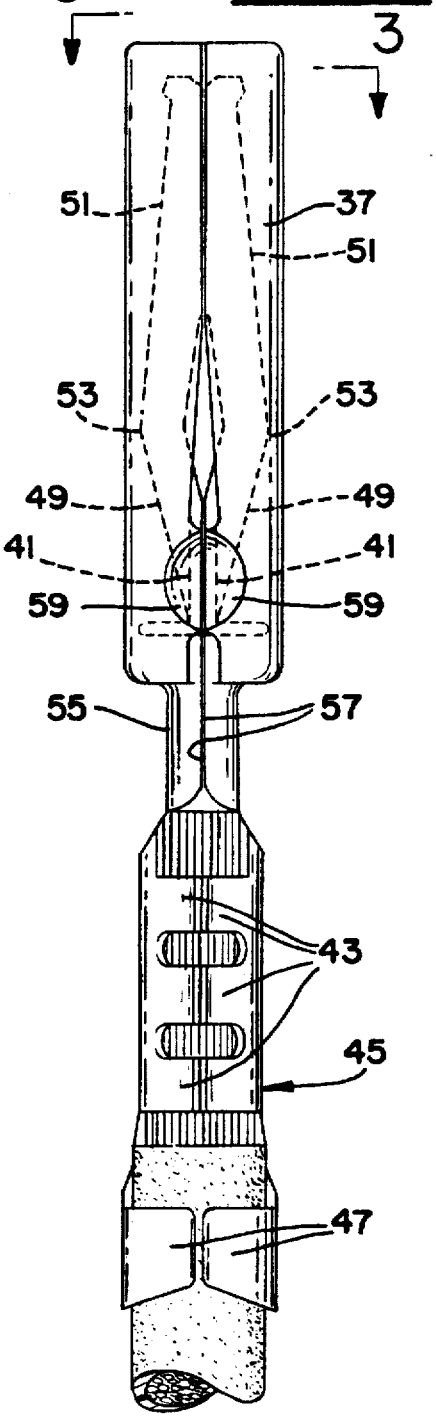
FIG. 2 PRIOR ART
FIG. 2 is a top plan view of a terminal according to Wymelenberg connected with an electrical cable.
Figure 3:
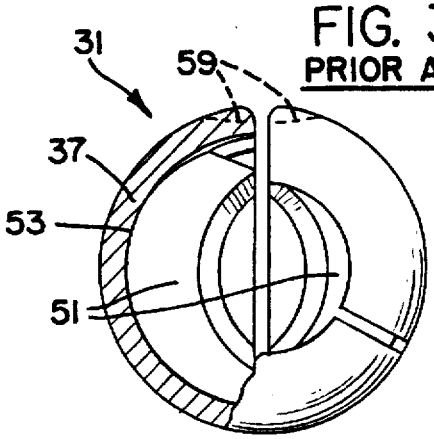
FIG. 3 PRIOR ART
FIG. 3 is a view taken along line 3—3 of FIG. 2.
Figure 4:
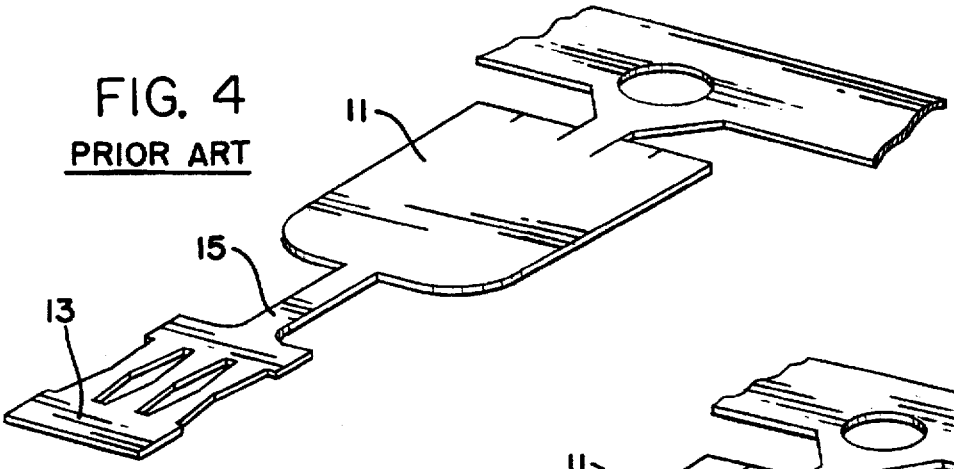
FIG. 4 PRIOR ART
FIGS. 4, 5, 6 and 7 are assembly views of a female terminal fabricated according to the invention disclosed in Longenecker et al.
Figure 5:
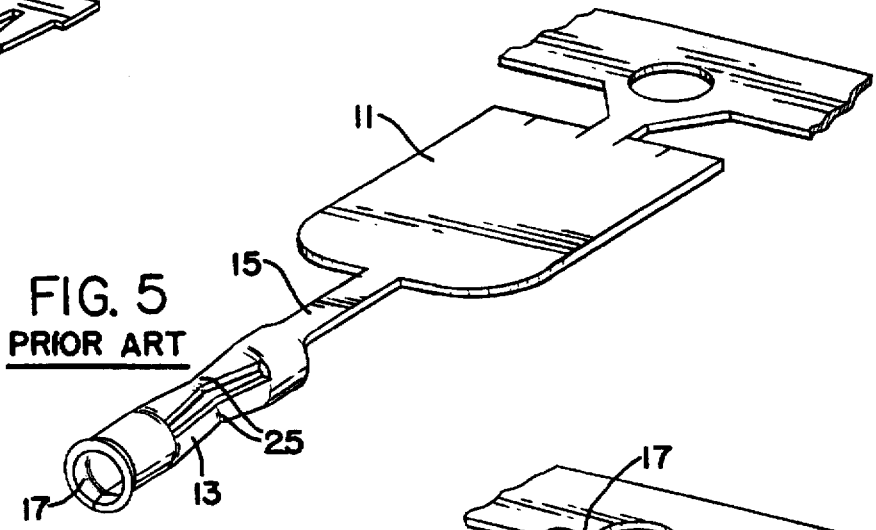
FIG. 5 PRIOR ART
Figure 6:
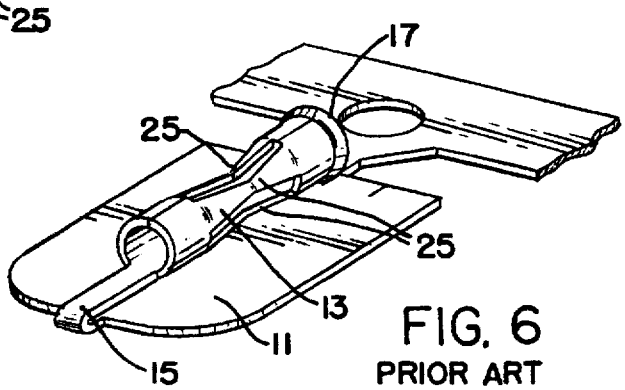
FIG. 6 PRIOR ART
Figure 7:
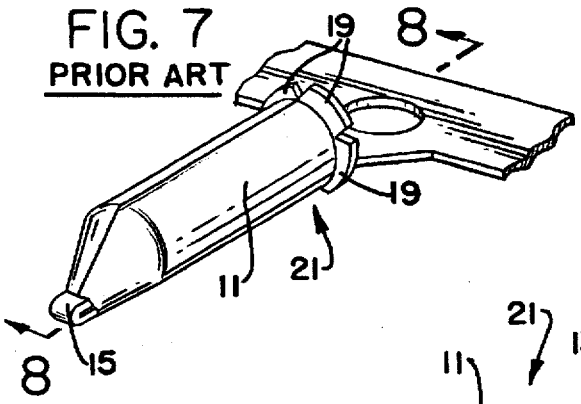
FIG. 7 PRIOR ART
Figure 8:
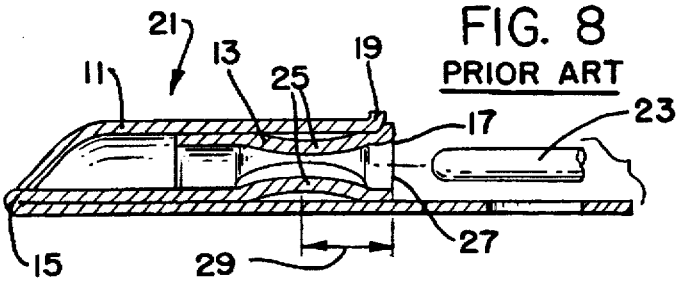
FIG. 8 PRIOR ART
FIG. 8 is a view taken along line 8—8 of FIG. 7.

Referring to FIGS. 9 through 13J, the female terminal 7, according to the present invention, has an attachment portion 80 at one end which includes wire crimp wings 82 and cable crimp wings 84. At the opposite end, the female terminal 7 has a contact portion 86. The contact portion 86 includes a split outer barrel 88 and a reduced diameter intermediate neck 90 which attaches the contact portion 86 to the attachment portion 80. The outer barrel 88 has two longitudinal edges 92 which define a split 94 when joined together.

Figure 9:
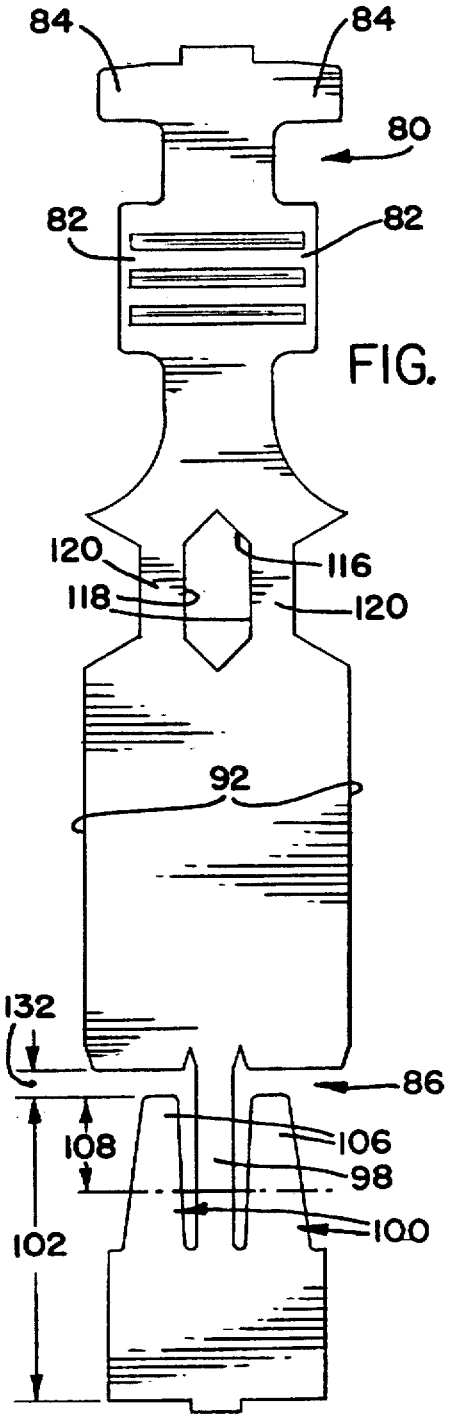
FIG. 9 is a top plan view of a blank utilized to fabricate the inventive female terminal of the present invention.
Figure 10:
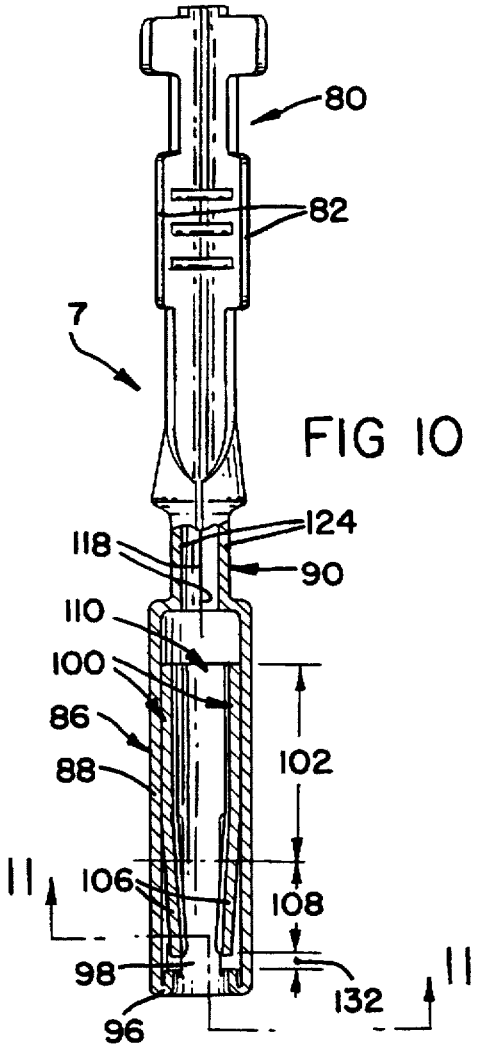
FIG. 10 is a top elevational view partially sectioned of the present inventive female terminal after assembly and before connection to an electrical terminal.
Figure 11:
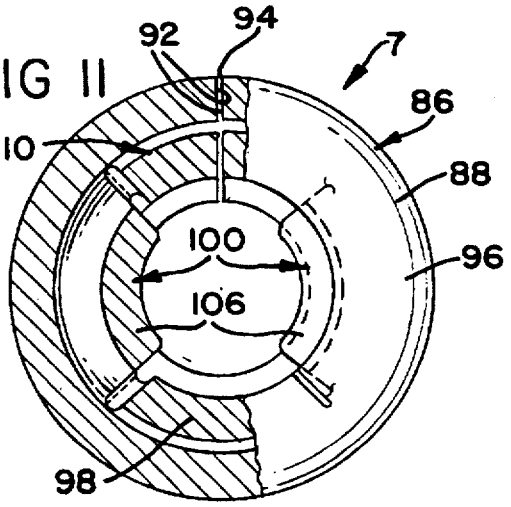
FIG. 11 is a view taken along line 11—11 of FIG. 10.
Figure 12:
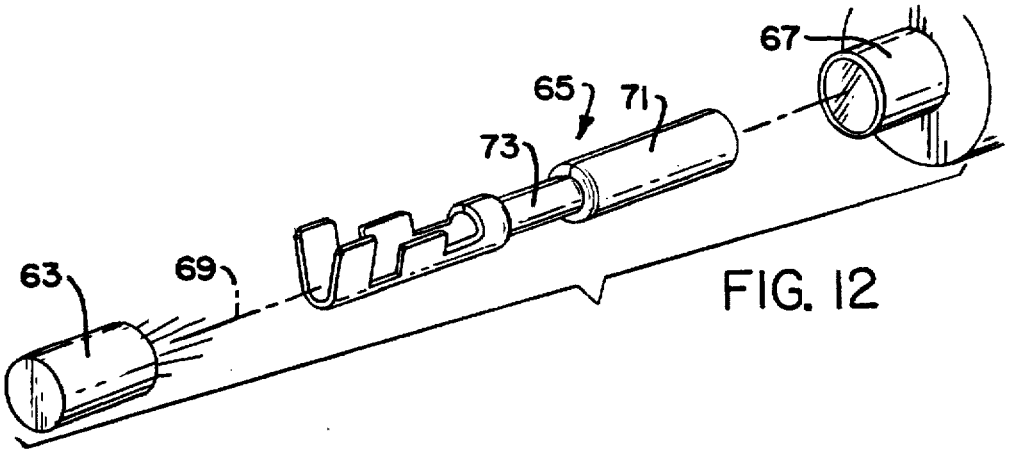
FIG. 12 is a perspective schematic view of an inspection technique which can be utilized on a female terminal.

A front end of the outer barrel 88 has a curled annular lip 96. Joined to the front end of the barrel 88 is a connection strap 98. The connection strap when the outer barrel 88 is formed is joined to the outer barrel 88 generally opposite the longitudinal edges 92, or more simply stated, generally along the longitudinal centerline of the barrel 88. The connection strap 98 is folded rearwardly into the outer barrel 88. The connection strap juxtaposes two spring contact or support beams 100. The support beams 100 have an overall length represented by dimension 102. The support beams 100 have an overall length (102) to length of joinder to the midstrap ratio between 2.5:1 to 1.5:1. In the embodiment of FIG. 9, dimension 102 is 5.50 mm. The distance from the end of the contact beam to the outer barrel dimension 132 is approximately 0.75 mm.

A front portion of the support beams 100 form contact fingers 106. Preferably, section 108 of the contact fingers 106 will be plated with gold or like material to enhance contact interface characteristics. The remainder of the terminal may be copper or other suitable conductor.

The front edges of the contact fingers 106 extend toward the front end of the barrel 88 and are radially spring-biased inwardly when contacting a mating end (male pin) terminal (not shown). When fully formed, the support beams 100 and connection strap 98 form an inner barrel 110 which is almost essentially independent of the outer barrel 88. The contact fingers 106 typically will be inclined at 4 to 8 degrees and preferably 6 degrees from the axial centerline of the terminal.

Figure 13A:
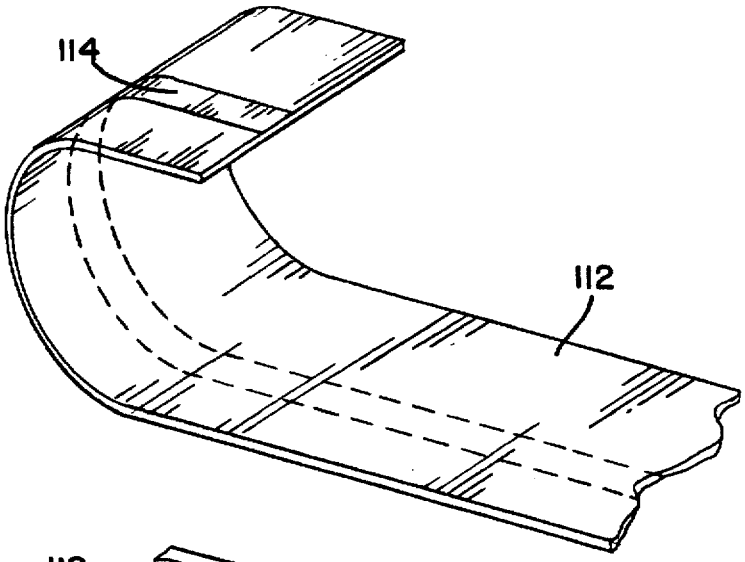
FIGS. 13A through 13J are progressive views illustrating fabrication of the female terminal of the present invention from a plated strip stock sheet material.
Figure 13B:
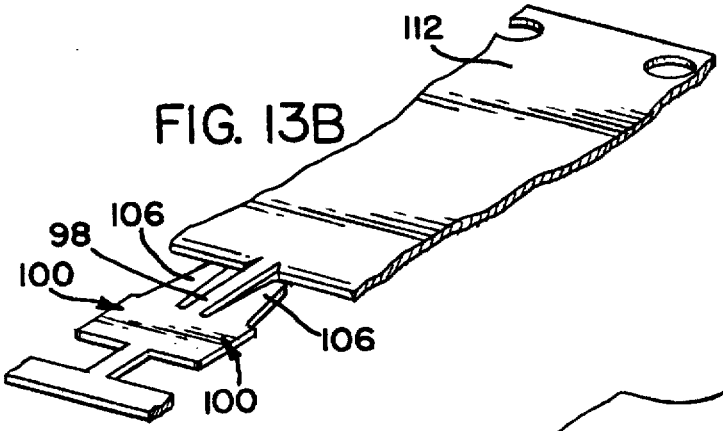
Figure 13C:
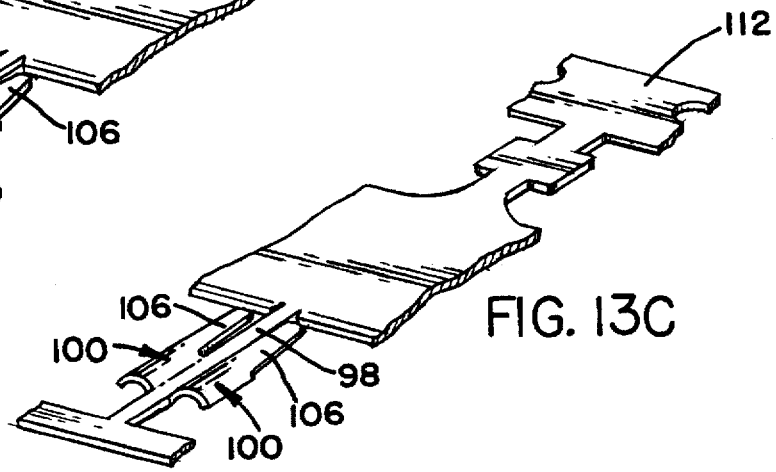

Referring primarily to FIGS. 9 and 13A–13J, the present inventive female terminal 7 is stamped from a strip stock 112 having interface plating region 114 which generally corresponds to section 108 of the contact fingers after forming. The first portion of the female terminal 7, which is stamped as shown in FIG. 13B, is the connection strap 98 along with the support beams 100. As the female terminal progresses down the assembly line, portions of the attachment portion are singulated (FIG. 13C) from the rest of the stock material. Also, in FIG. 13C, the contact beams are preformed to assume a more cylindrical shape.

Figure 13D:
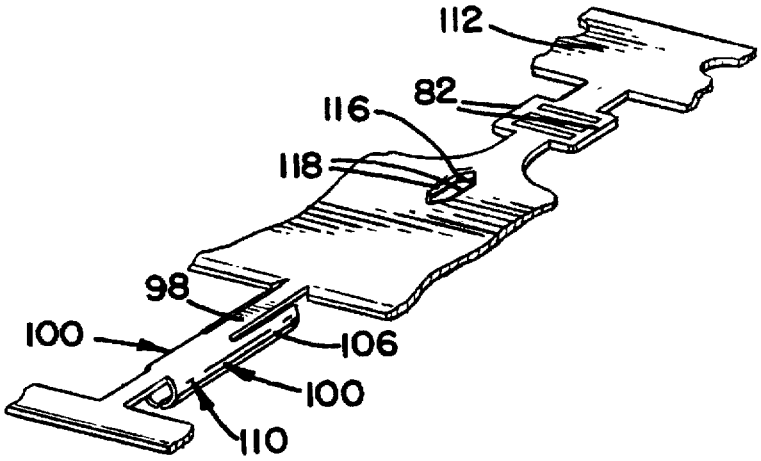
Figure 13E:
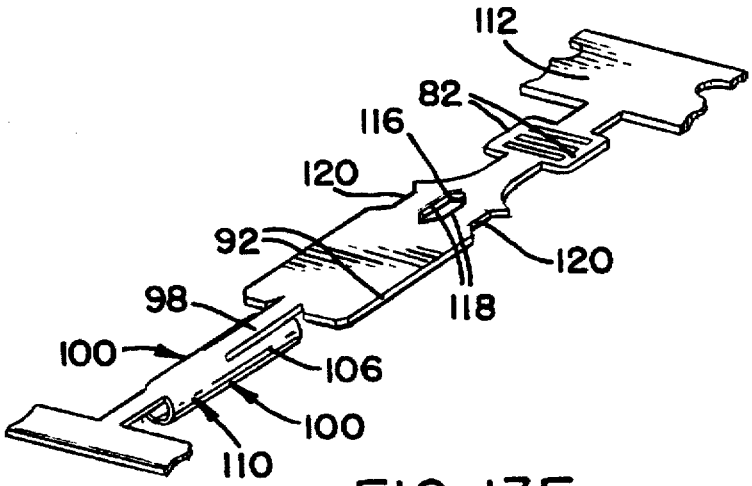

As best shown in FIG. 13D, the inner barrel 110 is more fully formed and a hexagonal slot 116 with corresponding longitudinal inner edges 118 is formed. FIG. 13E reveals the formation of the longitudinal edges 92. FIG. 13E also reveals the formation of the outer longitudinal surfaces 120 of the two separate shells 124 of the neck 90.

Figure 13F:
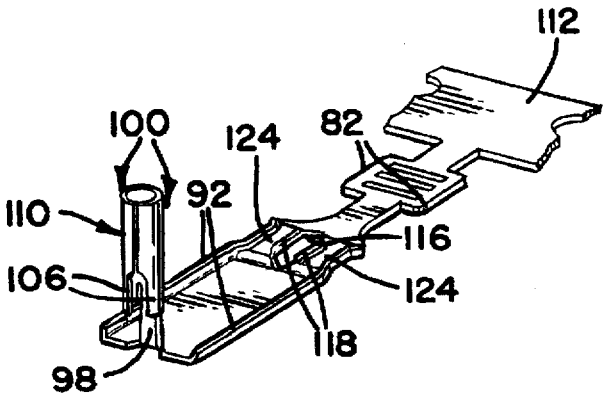

FIG. 13F reveals the singulation of the inner barrel 110 from the remainder of the strip stock 112 along with the preliminary forming of the neck shells 124 and of the outer barrel 88.

Figure 13G:
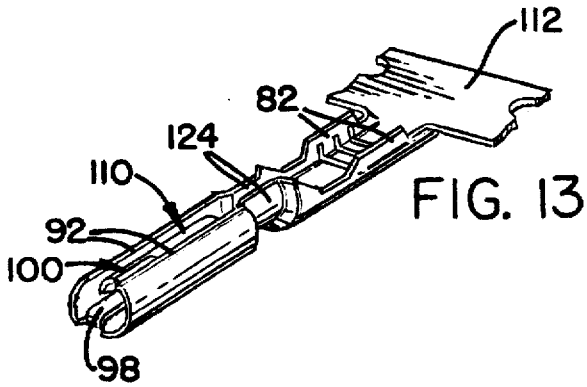
Figure 13H:
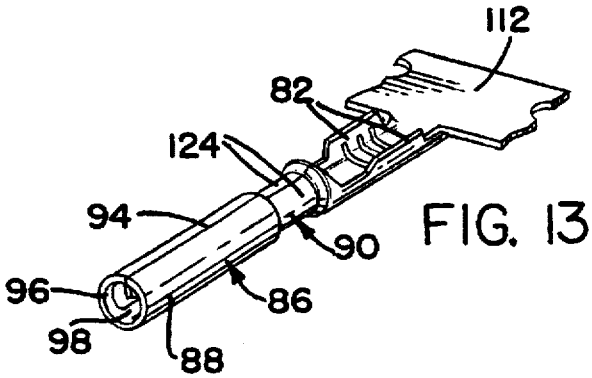

FIG. 13G demonstrates the closure of the outer barrel 88. The thickness of the strip stock material will typically be 0.20 mm. The outer barrel 88 will typically have a diameter of approximately 2.00 mm. The neck 90 will have an approximate diameter of only 1.20 mm. To keep the metal which forms the neck 90 from crimping inwardly, the hexagonal slot 116 is incorporated. This removal of metal allows the two neck shells 124 to be formed into semicircles and joined together ensuring a very clean inner diameter. A minimum clear inner diameter of 0.50 mm will be provided. Therefore, the neck 90 is essentially free and clear and the automated inspection technique aforedescribed with regard to FIG. 12, can be utilized at a high production rate to inspect for the presence and accurate forming of the support beams 100 and their associated contact fingers 106.

Figure 13I:
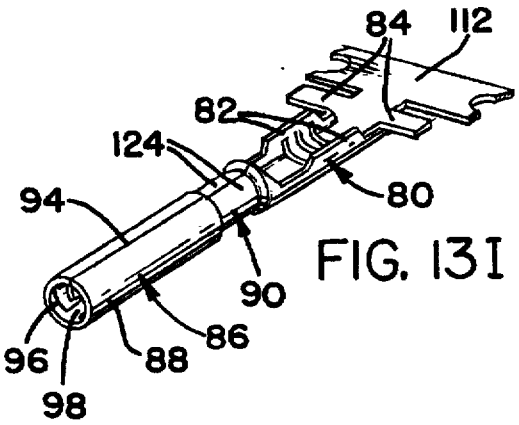
Figure 13J:
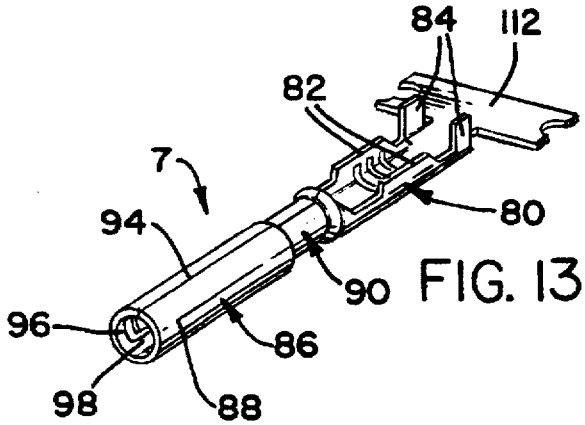

FIGS. 13I and 13J demonstrate the final stages of assembly before the female terminal 7 is singulated from the remainder of the strip stock 112.

While this invention has been described in terms of a preferred embodiment thereof, it will be appreciated that other forms could be adapted by one skilled in the art. Accordingly, the scope of this invention is to be considered limited only by the following claims.

What is claimed:

1. An electrical female terminal of a one-piece construction comprising:

a contact portion at one end and an attachment portion at an opposite end for attaching the terminal to an electrical cable;

the contact portion including a split outer barrel that is attached to the attachment portion by an intermediate neck of reduced diameter;

the outer barrel having a pair of longitudinal edges defining the split and an annular lip at its front end defining an entrance for plugging a mating terminal pin into the outer barrel;

the contact portion also including a connection strap joined to the outer barrel along a front end of the outer barrel generally opposite the longitudinal edges defining the splits, the connection strap being folded rearward into the outer barrel; and the contact portion further including two spring contact beams juxtaposed by the connection strap, the spring contact beams and connection strap being formed into an inner barrel encircled by the outer barrel, the spring contact beams having front edges extending toward the front end of the outer barrel, and spring contact beams being radially spring-biased inwardly against the mating terminal pin plugged within the outer barrel and wherein the terminal is constructed and arranged so that a light beam can be passed through the inner barrel, intermediate neck and attachment portion, and wherein the intermediate neck is formed from two halves, each half having an outer longitudinal edge and an inner longitudinal edge with a stamped gap formed between the inner longitudinal edge of the two halves, the intermediate neck when being formed bringing the inner longitudinal edges and the outer longitudinal edges together.

2. A terminal as described in claim 1, wherein the intermediate neck two halves are formed into shells before being joined together.

3. A terminal as described in claim 1, wherein the annular lip at the front end of the outer barrel is curled.

4. A terminal as described in claim 1, wherein the spring contact beams have a finger at their front end approximately radially tapered inwardly between four to eight degrees.

5. A terminal as described in claims 4, wherein the spring contact beam fingers are radially tapered inwardly approximately six degrees.

6. A terminal as described in claim 1, wherein the ratio of the total length of the spring contact beams compared to the length of joiner of the spring contact beams with the connection strap is between 2.5:1 to 1.5:1.

7. A electrical female terminal of a one-piece construction comprising:

a contact portion at one end, an attachment portion at the opposite end for attaching the terminal to an electrical cable;

the contact portion including a split outer barrel that is attached to the attachment portion by an intermediate neck of a reduced diameter, the intermediate neck being formed from two halves, each half having an outer longitudinal edge and an inner longitudinal edge with a stamp gap formed between the two inner longitudinal edges before joining of the halves together;

the outer barrel having a pair of longitudinal edges defining the split of the outer barrel, and an annular lip at its front end defining an entrance for plugging a mating terminal pin into the outer barrel;

the contact portion also including a connection strap joined to the outer barrel along a front edge of the outer barrel generally opposite the longitudinal edges defining the split of the outer barrel, the connection strap being folded rearwardly into the outer barrel; and the contact portion further including two spring contact beams juxtaposed by the connection strap, the spring contact beams and connection strap being formed into an inner barrel encircled by the outer barrel, the spring contact beams having front ends tapered radially inwardly between four to eight degrees, the front ends extending toward the front end of the outer barrel and the spring contact beams being radially spring-biased against the mating terminal pin plugged within the outer barrel.

* * * * *